United States Patent [19]

Aichinger et al.

[11] Patent Number: 5,029,338

[45] Date of Patent: Jul. 2, 1991

[54] X-RAY DIAGNOSTICS INSTALLATION

[75] Inventors: Horst Aichinger, Fuerth; Karlheinz Koehler, Herzogenaurach, both of Fed. Rep. of Germany

[73] Assignee: Siemens Aktiengesellschaft, Berlin and Munich, Fed. Rep. of Germany

[21] Appl. No.: 244,343

[22] Filed: Sep. 15, 1988

[30] Foreign Application Priority Data

Oct. 19, 1987 [DE] Fed. Rep. of Germany ... 8714009[U]

[51] Int. Cl.[5] ..... H05G 1/64

[52] U.S. Cl. ..... 378/99; 378/108

[58] Field of Search ..... 378/99, 108–112, 378/117; 358/111; 379/99, 108

[56] References Cited

U.S. PATENT DOCUMENTS

| | | | |
|---|---|---|---|
| 4,185,198 | 1/1980 | Fujimoto | 358/111 |
| 4,335,307 | 6/1982 | De Vries et al. | 378/99 |
| 4,335,311 | 6/1982 | Lutz et al. . | |
| 4,442,538 | 4/1984 | Haendle | 378/99 |
| 4,472,826 | 9/1984 | van de Ven | 378/97 |
| 4,517,594 | 5/1985 | Horbaschek | 378/99 |
| 4,749,257 | 6/1988 | Klausz | 378/99 |
| 4,809,309 | 2/1989 | Beekmans | 378/99 |

FOREIGN PATENT DOCUMENTS

| | | |
|---|---|---|
| 0038666 | 10/1981 | European Pat. Off. . |
| 0217456 | 4/1987 | European Pat. Off. . |
| 2577374 | 8/1986 | France . |
| 2582502 | 12/1986 | France . |

*Primary Examiner*—Craig E. Church

*Attorney, Agent, or Firm*—Hill, Van Santen, Steadman & Simpson

[57] ABSTRACT

An x-ray diagnostics installation has an image intensifier/video chain for generating a television image of an examination subject. A portion of the light generated by the output screen of the x-ray image intensifier is directed to a semiconductor detector which monitors the average brightness of the output luminescent screen so that the x-ray dose can be accordingly controlled. The detector has a surface on which the entire output image of the x-ray image intensifier can be imaged, and is connected to a control unit which selects a portion of the semiconductor detector surface which will be used to generate the control signal. The detector includes a diaphragm in the form of a liquid crystal matrix, the matrix being controllable by the control unit to selectively admit or block light to the surface of the semiconductor detector, thereby controlling the regions which will be used to generate the control signal.

1 Claim, 1 Drawing Sheet

X-RAY DIAGNOSTICS INSTALLATION

BACKGROUND OF THE INVENTION

1. Field of the Invention

The present invention is directed to an x-ray diagnostics installation, and in particular to such an installation having means for monitoring the average image brightness on the output luminescent screen of the x-ray image intensifier, and controlling the operation of the x-ray tube based thereon.

2. Description of the Prior Art

An x-ray diagnostics installation is disclosed in European Application 0 217 456 which includes a detector for the average image brightness of the output luminescent screen of the x-ray image intensifier in a predetermined region of the screen. The detector is a semiconductor surface on which the entire output image of the x-ray image intensifier output screen can be imaged, and includes means for selecting a predetermined region of the semiconductor surface for use in generating the control signal. The detector consists of an array of a plurality of individual detector elements, the outputs of the individual elements being combined to form a brightness signal for the selected measuring field An output amplifier must be provided for each detector element, which requires a considerable circuit outlay, and reduces the resolution obtainable by the array because of the physical space which must be occupied by each amplifier, thereby limiting the number of detector elements which can be provided in a given area.

SUMMARY OF THE INVENTION

It is an object of the present invention to provide an x-ray diagnostics installation of the type described above wherein the circuit outlay is reduced, and wherein measuring fields having variable shapes can be selected.

The above object is achieved in accordance with the principles of the present invention in an x-ray diagnostics installation wherein the detector is a large-area semiconductor detector, with a diaphragm disposed in front thereof consisting of a liquid crystal matrix. The diaphragm is controlled by a control unit, which selects a predetermined region of the total area of the semiconductor detector on which light will be permitted to be incident. A particularly low circuit outlay for signal editing results. Selection of the measuring field using the liquid crystal matrix is accomplished electronically. In contrast to the conventional array of light-sensitive discrete elements, only a single amplifier is required in accordance with the principles of the present invention, instead of the large number of amplifiers required to form the measured signal in conventional units.

DESCRIPTION OF THE PREFERRED EMBODIMENTS

Figure 1:
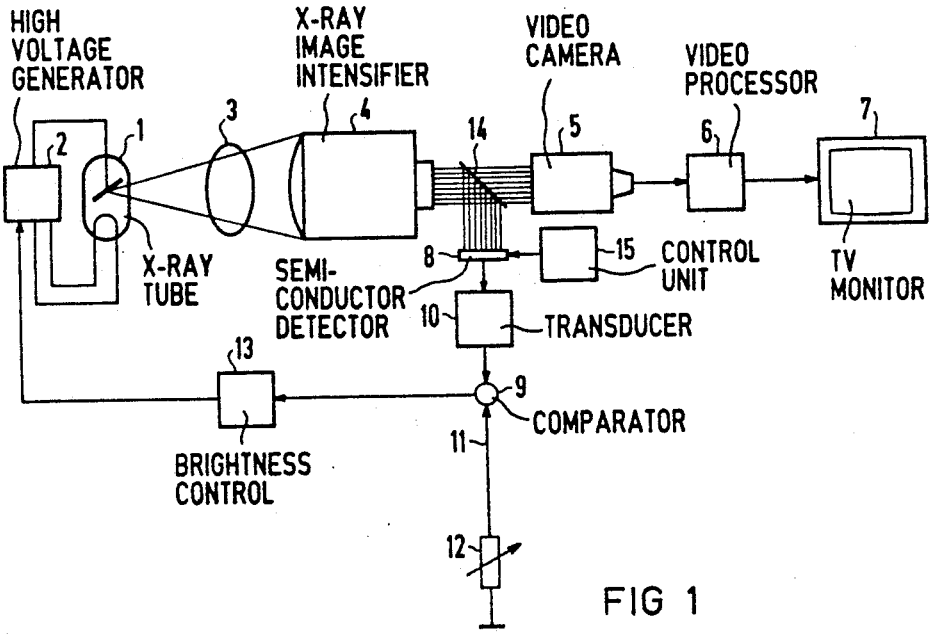
FIG. 1 is a schematic block diagram of an x-ray diagnostics installation constructed in accordance with the principles of the present invention.

An x-ray diagnostics installation constructed in accordance with the principles of the present invention is shown in FIG. 1. The installation includes an x-ray tube 1 which is fed by a high voltage generator 2. A patient 3 is transilluminated by x-radiation generated by the x-ray tube. X-radiation attenuated by the patient 3 is incident on an input screen of an x-ray image intensifier 4. A light image corresponding to the x-ray image is present on the output luminescent screen of the x-ray image intensifier 4. The light from this image is supplied to a video camera 5, which generates a signal supplied to a video processor 6, for display on a TV monitor 7.

To maintain the average picture brightness in a measuring field of the output screen of the x-ray image intensifier 4 at a constant level, a semi-reflective mirror 14 directs a portion of the light from the output luminescent screen to a semiconductor detector 8. The semiconductor detector 8 functions as an actual value generator, and supplies a signal to an actual value input of a comparator 9 via a transducer 10. The comparator 9 is supplied with a rated value 11, which may be set, for example, by a potentiometer 12. Depending upon the difference between the actual value and the rated value, the high voltage generator 2 is controlled by a brightness control 13, connected to the output of the comparator 9. The operating parameters of the x-ray tube, such as filament voltage and current, can be adjusted to generate an x-ray dose to maintain a desired brightness level. The semiconductor detector 8 has a surface on which the entire output image of the x-ray image intensifier 4 can be imaged by the semi-reflective mirror 14. A control unit 15 electronically selects a region of the semiconductor detector 8 which will be used to generate the actual value signal, in accordance with a desired measuring field. The semiconductor detector 8 permits selection of a number of different measuring fields, which may vary in position, shape and size.

Figure 2:
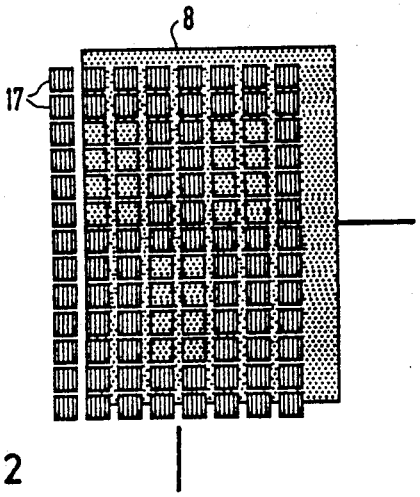
FIG. 2 is a plan view of a detector constructed in accordance with the principles of the present invention for use in the x-ray diagnostics installation of FIG. 1.

Further details of the semiconductor detector 8 are shown in FIG. 2. The semiconductor detector 8 is a large-area detector formed by a single detector element, for example, a single photodiode. For selecting the desired measuring field, a diaphragm is disposed in front of the semiconductor detector 8 consisting of a liquid crystal matrix formed by a plurality of liquid crystals 17. The respective light transmissivity of the individual liquid crystals 17 is controlled by the control unit 15. Each crystal can be controlled to admit or block incoming light to the detector 8. In FIG. 2, for example, the shading indicates the selection of three measuring fields, i.e., a central measuring field and two lateral measuring fields.

In the embodiment shown in FIG. 2, signal interpretation within a measuring field is also possible. In conventional devices, the measuring signal of each individual photodiode of the measuring field matrix can be electronically multiplied by a weighting factor before adding the outputs to form the total actual value signal. The selection of weighting factors may be selected, for example, depending upon the organ of the patient under examination. In the detector of the present invention, such a weighting can be achieved by driving only a portion of the liquid crystals 17 of the matrix within a measuring surface so as to be transmissive. An adaptation to the subject to be examined can thus be achieved by varying the liquid crystals driven transmissive per unit of surface area in the region of the measuring field.

Moreover, peak value control can be achieved by serially reading out the individual matrix elements of the selected measuring field with only the maximum value of the signal distribution being used to form the actual value. To match the brightness control to different subjects, known methods of pattern recognition can also be applied in selecting the matrix elements which are to contribute to the formation of the actual value signal.

The above-described techniques for forming measuring fields for a video camera can also be employed if a sheet film (photographic) camera is used.

If the semiconductor detector 8 is used for direct exposure, instead of an ionization chamber, the advantages described above of a flexibility in the formation of the measuring field, signal weighting, and average value/peak value control, can be implemented. Because the image intensifier is arranged following the film cassette in such installations, exposure corrections which, for example, can be stored in tabular form in the memory of an automatic exposure unit, are needed to compensate for the effects of increased radiation hardness occurring upon passage of the radiation through the cassette. The degree of transparency of the patient to the radiation can be calculated by a test transillumination before initiating the direct examination exposure, and the selected gating will then be entered in the automatic exposure unit. The necessary exposure correction can then be taken from the stored table.

Although modifications and changes may be suggested by those skilled in the art it is the intention of the inventors to embody within the patent warranted hereon all changes and modifications as reasonably and properly come within the scope of his contribution to the art.

We claim as our invention:

1. An x-ray diagnostics installation for examining a patient comprising:

means for generating an x-ray beam directed to said patient;

means for generating an x-ray image from radiation attenuated by said patient;

means for converting said x-ray image into a light image;

means for generating a television image from said light image;

detector means for monitoring the brightness of said light image and generating a control signal for said means for generating an x-ray beam to maintain said brightness at a selected level, said means for detecting including a single, semiconductor detector onto which the entirety of said light image can be imaged and which generates an electrical signal corresponding to light incident thereon, a liquid crystal matrix disposed in front of and completely covering said semiconductor detector consisting of a plurality of liquid crystals, and means for directing the entirety of said light image onto said matrix; and control means connected to said liquid crystal matrix for driving selected liquid crystals in said liquid crystal matrix to a light transmissive state for selecting regions of said semiconductor detector on which light is incident.

* * * * *